US005357178A

United States Patent [19]

Kapitan

[11] Patent Number: 5,357,178

[45] Date of Patent: Oct. 18, 1994

[54] WEB TENSIONING CONTROL SYSTEM

[75] Inventor: Brian A. Kapitan, Oak Creek, Wis.

[73] Assignee: Gettys Corporation, Racine, Wis.

[21] Appl. No.: 89,050

[22] Filed: Jul. 9, 1993

[51] Int. Cl.[5] ..... B65H 59/38

[52] U.S. Cl. ..... 318/7; 318/6

[58] Field of Search ..... 318/6, 7

[56] References Cited

U.S. PATENT DOCUMENTS

| | | | |
|---|---|---|---|
| 3,857,261 | 12/1974 | Wilcox . | |
| 4,011,743 | 3/1977 | Peterson et al. . | |
| 4,160,195 | 7/1979 | Sakamoto | 318/7 |
| 4,202,476 | 5/1980 | Martin . | |
| 4,473,924 | 10/1984 | Hartmannsgruber et al. . | |
| 4,645,109 | 2/1987 | Fleissner . | |
| 4,788 606 | 11/1988 | Uchikoshi | 318/7 |
| 4,809,188 | 2/1989 | Willits et al. . | |
| 4,847,775 | 7/1989 | Roch et al. . | |
| 4,967,222 | 10/1990 | Nitsch . | |
| 4,979,691 | 12/1990 | Kobayashi | 318/6 |
| 5,125,592 | 6/1992 | Sato | 318/6 |
| 5,188,580 | 2/1993 | Rutledge et al. . | |
| 5,222,684 | 6/1993 | Yoneda et al. | 318/6 |

*Primary Examiner*—William M. Shoop, Jr.
*Assistant Examiner*—Karen Masih
*Attorney, Agent, or Firm*—Litman, McMahon & Brown

[57] ABSTRACT

A motor control system for controlling a plurality of drive motors in a web tensioning system includes individual motor control circuits for each motor in the system. The web tensioning system includes a main exit drive motor and a plurality of helper drive motors. A single tensiometer is positioned near the exit motor to sense web tension at this point. Each helper motor control circuit is connected to this exit tensiometer to receive the exit tension as a tension feedback. Based solely upon this feedback value and a speed feedback from the associated motor, each motor control circuit is programmed to independently provide tension based control for its associated helper motor to compensate for its proportionate share of system induced drag on the web, resulting in uniform tension on the web throughout its path. Each motor control circuit can be switched between the tension based control and a speed based control format.

36 Claims, 7 Drawing Sheets

Fig.3. OVERALL SYSTEM LOGIC

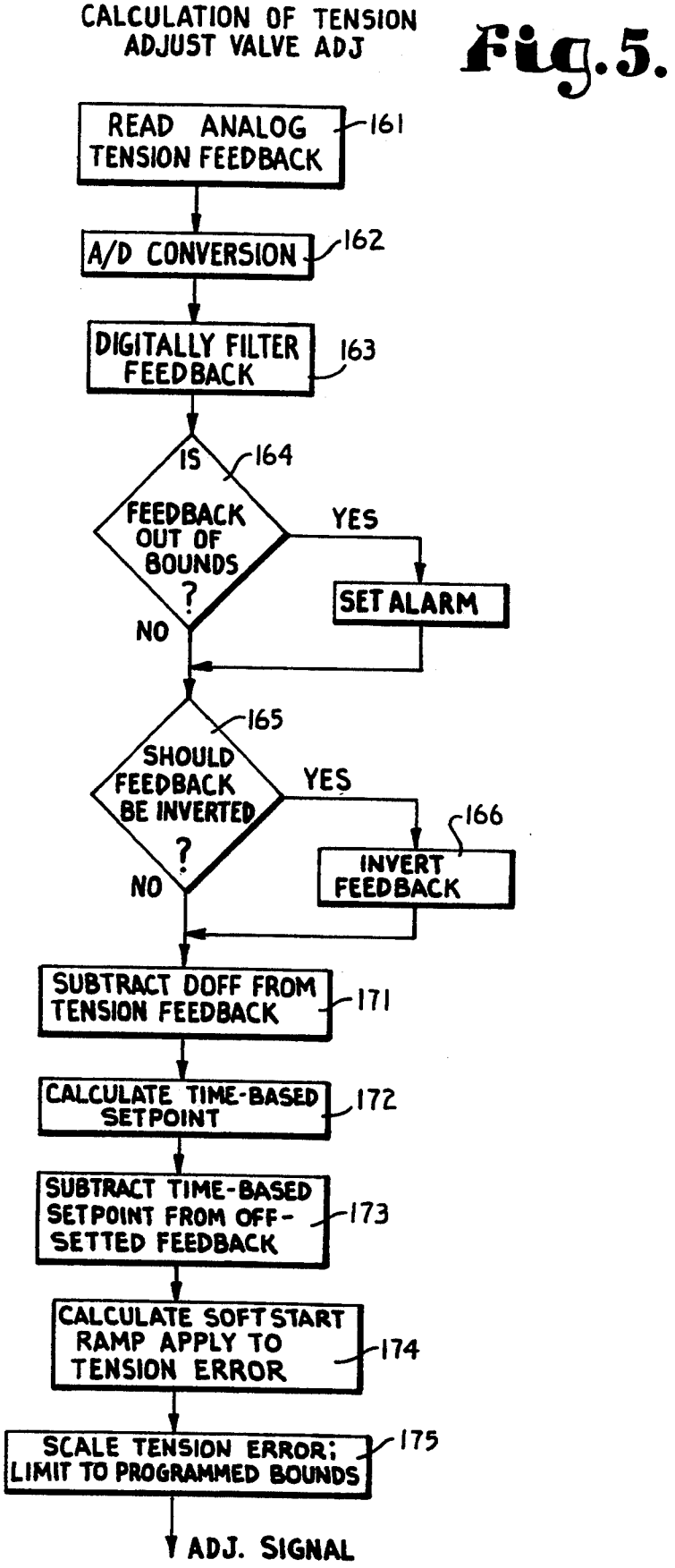
CALCULATION OF TENSION ADJUST VALVE ADJ
Fig. 5.
READ ANALOG TENSION FEEDBACK
161
A/D CONVERSION
162
DIGITALLY FILTER FEEDBACK
163
IS FEEDBACK OUT OF BOUNDS ?
164
YES
SET ALARM
NO
SHOULD FEEDBACK BE INVERTED ?
165
YES
166
INVERT FEEDBACK
NO
SUBTRACT DOFF FROM TENSION FEEDBACK
171
CALCULATE TIME-BASED SETPOINT
172
SUBTRACT TIME-BASED SETPOINT FROM OFF-SETTED FEEDBACK
173
CALCULATE SOFTSTART RAMP APPLY TO TENSION ERROR
174
SCALE TENSION ERROR; LIMIT TO PROGRAMMED BOUNDS
175
ADJ. SIGNAL

WEB TENSIONING CONTROL SYSTEM

BACKGROUND OF THE INVENTION

1. Field of the Invention

The present invention relates to a web tensioning control system, and more particularly to a control system for controlling a web tensioning apparatus in which a web of material, such as a textile web or the like, is pulled through a vat of liquid by an exit motor driving a corresponding pinch or nip roller. In order to compensate for various drag components on the web, a plurality of helper motors are provided at regular intervals within the web to push the web along. The inventive control system and component circuits are designed to provide uniform tension throughout the web by reliably and efficiently controlling the tension applied to the web by each helper motor based upon a tension feedback readout from a single tension sensor located near the exit motor.

2. Description of the Related Art

Web tensioning systems, particularly systems in which a web of material is pulled through a vat of liquid by a exit motor driving a pinch or nip roller, are well known for the treatment of textiles and the like. In many such systems, in order to attempt to provide a uniform tension on the web throughout the vat, a plurality of helper motors are arrayed above the vat at regular intervals to compensate for various drag components on the web. A plurality of guide rollers are immersed in the vat, with the material web alternately partially encircling one or more guide rollers and thence through a helper motor pinch roller such that the continuous web follows a complex path through the vat to maximize exposure of the material to the liquid.

It is known to provide individual controls for each helper motor to allow the helper motors to make differing load compensation contributions depending upon sensed web tension values at the helper motor locations. In general, such individual controls require separate tension sensors at each or most helper motor locations, and also require each helper motor to be sized to compensate for any drag induced throughout the entire system. Thus, a number of relatively large horsepower helper motors and a plurality of corresponding tensiometers must be used to generate helper motor control signals. Furthermore, in known systems, the helper motors are only controllable via a web tension feedback and thus the helper motors cannot be operated via a speed based control during threading and emergency conditions.

An example of such a prior art system is disclosed in U.S. Pat. No. 4,645,109 to Fleissner. Systems such as Fleissner's require an unacceptably high initial equipment expense for the large motors and corresponding tensiometers and continuing large maintenance costs for maintaining such an array of tensiometers, which are prone to breakage and readout error.

Furthermore, upon initial start-up of a system such as Fleissner's, drag components on the web are constantly shifting due to acceleration forces, and analog motor control circuits tend to overcompensate for the sensed tension errors, often resulting in wide tension fluctuations. This can result in tearing of breaking the web, which means that the entire system must be shut down and drained so that the web can be laboriously rethreaded through the pinch rollers and guide rollers. This leads to another problem inherent in prior art systems, i.e. in the event of web breakage, a control system based solely upon tension sensing can overspeed as a result of web breakage or during initial material feed, when there is no tension to be sensed. This can result in the motors literally throwing the material web out of the vat at high speed with consequent danger to surrounding personnel and machinery.

It is clear then, that a need exists for a precise, digitally based web tensioning control system in which a plurality of helper motors can be sized to compensate for induced material drag only within their corresponding sector of the web. Such a control system should allow control parameters to be instantaneously switched between a web tension based feedback control and a web speed based feedback control for those situations in which no web tension is present. Such a control system should also be capable of "soft starts" whereby widely varying tension conditions due to acceleration during start-up are not chased wildly, with consequent damage to or breakage of the material web. Finally, such a control system should provide individual helper motor tension control signals based solely upon a single exit tension sensor readout, which motor control signals result in a relatively uniform tension throughout the material web.

SUMMARY OF THE INVENTION

In the practice of the present invention, a web tensioning system includes a plurality of guide rollers arrayed throughout a liquid vat. A number of helper motors are regularly arrayed above the vat, with each helper motor driving a corresponding pinch or nip roller used to push the web along. A main exit motor is positioned above the vat where the web finally exits the vat, and is located near an exit tension sensor, such as a load cell. An entrance tension sensor, which is preferably be a dancer type sensor but may be a load cell or other tensiometer, is provided near the point at which the web first enters the vat. In order to maximize web exposure to the liquid, the material web follows a complex path through the vat, being alternately threaded through a plurality of guide rollers and then up and over a helper motor pinch roller, with this sequence being repeated with each helper motor and corresponding series of guide rollers.

A plurality of digital helper motor control circuits are provided, one for each helper motor, with each circuit outputting a current to the respective helper motor, based upon desired web tension parameters and alternative tension or speed feedback loops.

Each helper motor control circuit includes a pair of alternative control loops with a first control loop based upon a speed feedback for controlling the corresponding helper motor during times when there is no tension on the web. The second control loop is tension based, i.e. it controls the corresponding helper motor based upon a tension feedback from the exit tension sensor. The control system selects one or the other control loop based upon a digital switching signal.

In the tension based control loop, an analog tension input is digitized and subjected to a comparison to detect an alarm condition, i.e. a tension value either exceeding a high alarm limit or being less than a low alarm limit. In the event of either alarm condition, a fault signal is generated. A torque sharing and soft start determination is made so that the corresponding helper motor is gradually accelerated during start-up, i.e. the tension control signal is essentially ignored, until a steady state system condition is reached. The desired steady state condition involves the respective helper motor providing its share of the torque needed to overcome the drag forces on the material web. When the system is running at steady state, a helper motor compensation loop provides a variable motor current to the corresponding helper motor based upon a comparison of the actual sensed tension value with a desired value, compensated for acceleration effects and variations in perceived feedback values between the individual control circuits. Each helper motor compensation loop individually controls the corresponding helper motor with no intercommunication between it and the other helper motor control circuits, with the net desired result being a uniform tension on the web throughout its complex path. An overspeed torque limit circuit optionally prevents the corresponding helper motor from "running away" or "slipping" during operation.

OBJECTS AND ADVANTAGES OF THE PRESENT INVENTION

The objects and advantages of the present invention include: providing a web tensioning control system in which a plurality of helper motors in a web tensioning system are torque controlled to provide a uniform tension throughout an associated material web; providing such a control system in which each individual helper motor includes a corresponding control circuit; to provide such a control system in which each helper motor control circuit has two alternative control loops, one based upon web speed and the other based upon web tension, with a digitally controlled switch determining the particular control loop to be employed at any moment; to provide such a control system in which a soft start of the tensioning system can be accomplished during system start-up to prevent damage to or breakage of the material web and to prevent unstable operation of the helper motors; to provide such a control system in which an alarm condition is detected in the event that sensed web tension is outside of preset alarm limits; to provide such a control system in which system output torque is limited in the event of sensing motor overspeed; to provide such a control system in which each individual helper motor control circuit provides motor torque control of its associated motor based upon sensed web tension at the web exit point of the liquid vat; to provide such a control system in which individual helper motor control circuits do not communicate with each other, but nevertheless cooperate such that each helper motor compensates for a proportionate share of the web drag forces to provide a uniform tension throughout the material web; and to provide such a control system which is reliable, efficient and economical in operation, is capable of a long operating life and which is particularly well adapted for the intended use thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 5 is a logical flowchart illustrating the calculation of a preliminary motor control tension adjustment value.

DETAILED DESCRIPTION OF THE PREFERRED EMBODIMENTS

I. Introduction and Environment

Figure 1:
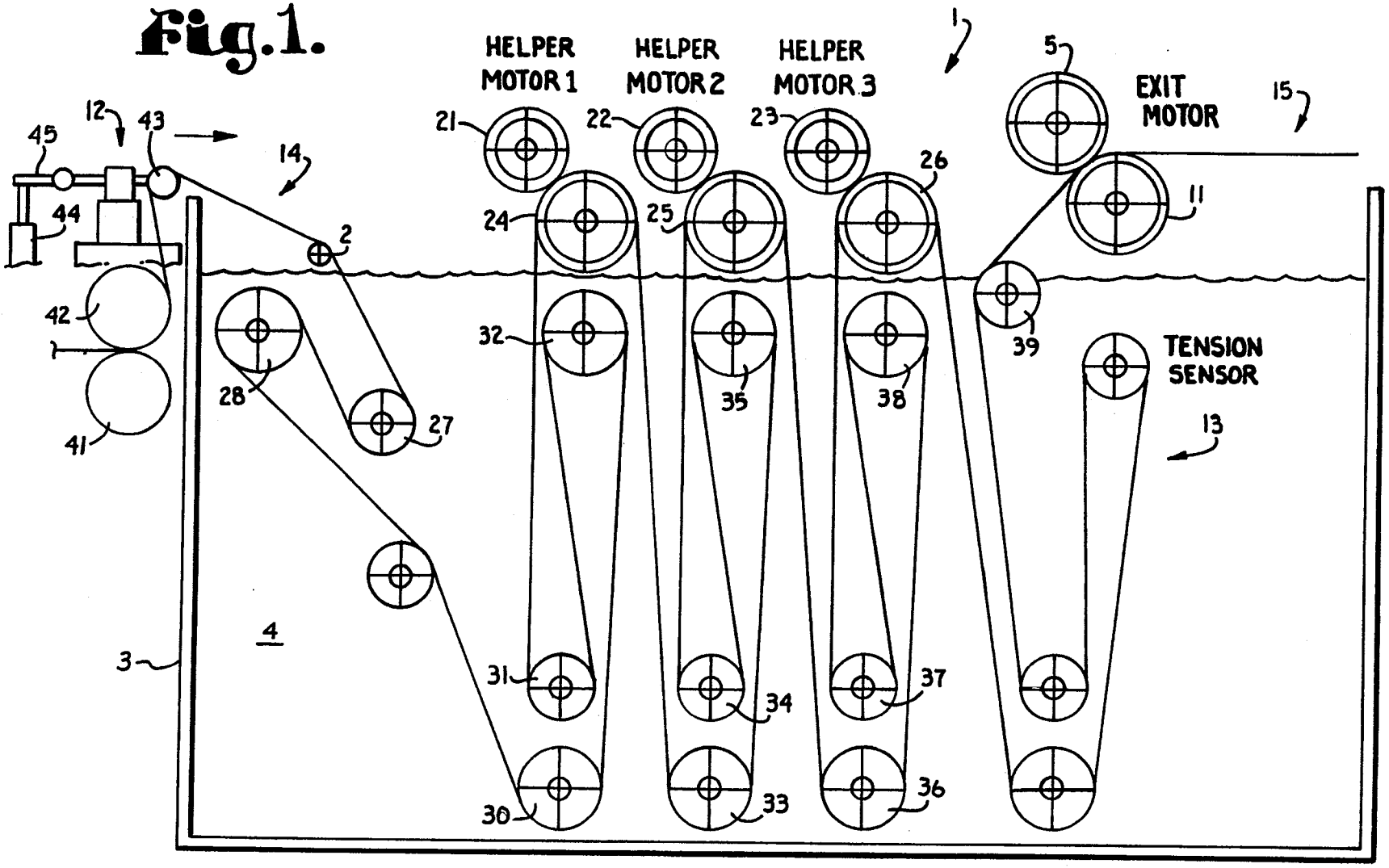
FIG. 1 is a schematic side elevational view of a load sharing web tensioning system for which the motor control system of the present invention was designed.

As required, detailed embodiments of the present invention are disclosed herein; however, it is to be understood that the disclosed embodiments are merely exemplary of the invention, which may be embodied in various forms. Therefore, specific structural and functions details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience and reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the structure being referred to. Said terminology will include the words specifically mentioned derivatives thereof and words of similar import.

Referring to the drawings in more detail, reference numeral 1 generally designates a web tensioning system in which a web of material 2, such as a textile weave, is drawn through a vat 3 filled with a liquid 4. The liquid 4 may be water, a cleaning fluid, a dye, etc.

A main or exit drive motor 5 drives a pinch roller 11 to pull the web 2 through the vat 3 under tension. A pair of tensiometers 12 and 13 are positioned proximate the web entrance 14 and the web exit 15 of the vat 3. The entrance tensiometer 12 provides a tension value which is used to control the torque supplied to the web 2 by the exit motor 5. The exit tensiometer 13 comprises a load cell while the entrance tensiometer comprises a dancer, to be described below, although it is foreseen that different types of tensiometers can be used for either location.

A plurality of helper motors 21, 22 and 23, are positioned above the vat 3, with each helper motor 21–23 driving a corresponding pinch roller 24–26, respectively. The exit tensiometer 13 provides a web tension value which is used to control the torque supplied to the web 2 by the helper motors 21–23. Each of the helper motors 21, 22 and 23 is individually and selectively controlled by a separate helper motor control circuit 51, in a manner as described below.

A plurality of guide rollers 27–39 are positioned below the surface of the liquid 4. The web 2 is alternately threaded through the rollers 31–39 to create a complex path through the vat 3 for maximizing the exposure of the web 2 to the liquid 4. Note that each of the pinch rollers 24–26, the helper motors 21–23 and the exit motor 5 and pinch roller 11 are suspended above the liquid 4 to minimize exposure of these machines to the liquid as well as reducing drag on the motors and pinch rollers.

The entrance tensiometer 12 is shown as a conventional dancer unit with a pair of draft rolls 41 and 42 driven by a variable speed motor (not shown). A dancer roll 43 is counterbalanced by a pneumatic cylinder 44 attached to a beam 45. The web 2 is carried between the draft rolls 41 and 42 and up and over the dancer roll 43 and thence into the vat 3. Any slack or tension in the web 2 results in the dancer roller 43 being moved up and down, which alters the resistance in an attached rheostat (not shown) which altered resistance is then used to increase or decrease the speed of the draft rolls 41 and 42 or increase or decrease the speed of the exit motor 5, by connection to the motor controls associated with the motor 5.

II. Motor Control Circuits

Figure 2:
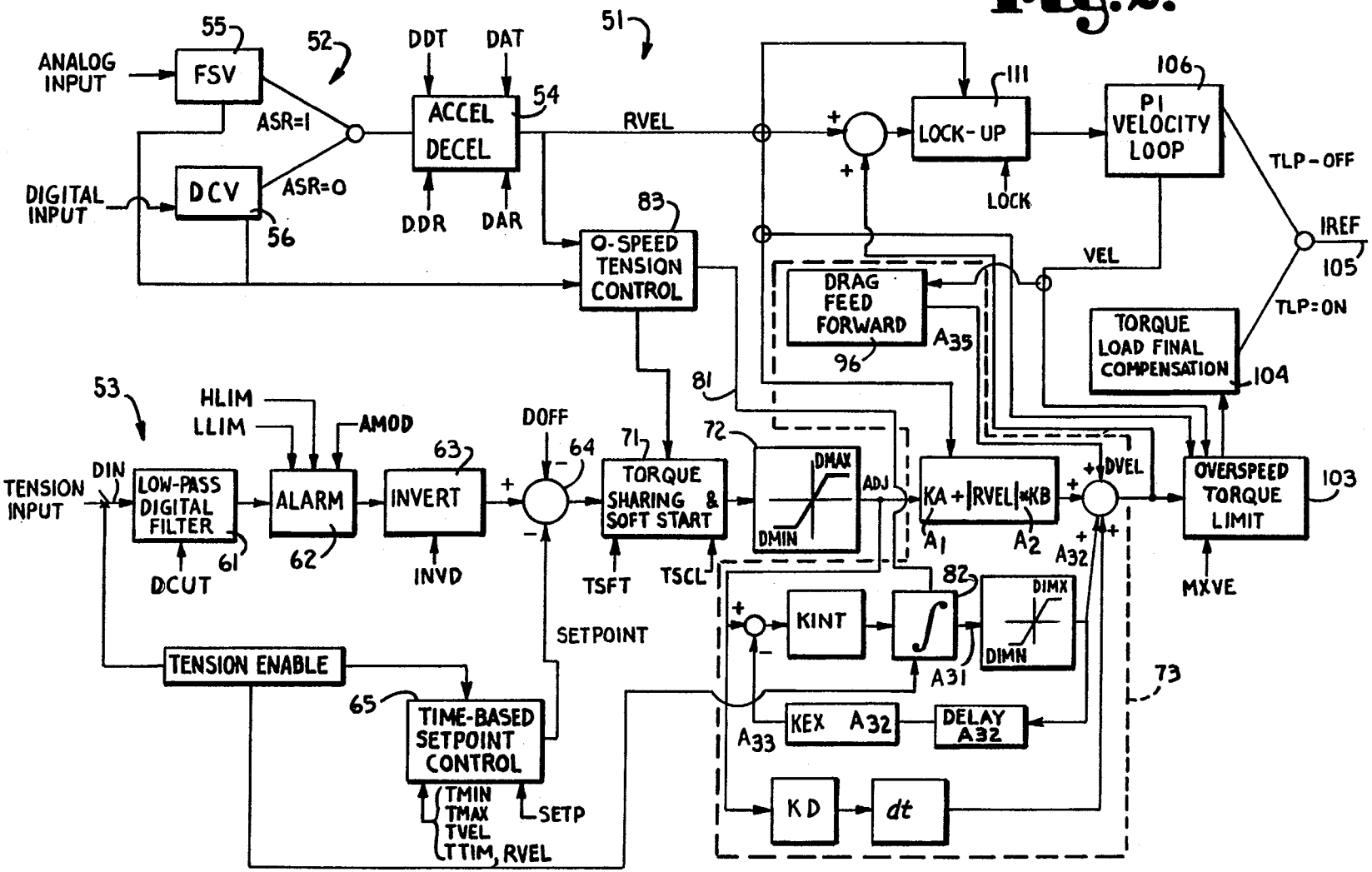
FIG. 2 is a schematic electrical block diagram of a motor control circuit in accordance with the present invention.

Referring to FIG. 2, a block diagram illustrates circuitry and logic blocks making up a single helper motor control circuit, generally designated as 51.

The upper portion of the diagram represents an alternative speed control loop 52 for generating a motor circuit IREF, while the lower portion of the diagram represents a torque control loop 53. The two control loops are alternative, but also somewhat interdependent, as will be explained below.

In the speed control loop 52, an acceleration/deceleration velocity profile generator 54 generates a computed digital velocity command RVEL, which is an internal representation of desired line speed. The accel/decel generator 54 accelerates or decelerates the value of RVEL to match a target value selected from either a scaled analog voltage input from box 55, where an analog voltage input is scaled to create a target speed value FSV, or, alternatively, a digital target speed value DCV from a source 56. A switching signal ASR, or analog speed reference, is internally generated to designate which target value FSV or DCV is to be used. FSV outputs a desired digital speed target value derived from an analog voltage applied at the analog input, while DCV simply stores an input digital speed target value.

The accel/decel generator 54 rate limits RVEL vs. the target value based upon four input parameters, DAT-digital acceleration time, DDT-digital deceleration time, DAR-digital acceleration rate, and DDR-digital deceleration rate. The generator 54 is controlled either by time or by rate, i.e. if the relevant time associated parameter, either DAT or DDT, is zero, then rate controlled acceleration/deceleration is used. Conversely, if the relevant time associated parameter is non-zero, then the rate associated parameters are ignored. For example, if the parameters DAT and DDT are set to 2.5 seconds, and the switching signal ASR is OFF, then any change in the target parameter DCV will cause the generator 52 to slew, or ramp, the digital velocity signal RVEL from its current value to the new target value over 2.5 seconds. If, however, DAT and DDT are set to zero, and the rate parameters DAR and DDR are set to 2 RPM/sec, the generator 52 will slew the value RVEL to match DCV at the rate of 2 RPM/sec, and the time required to slew RVEL to the new target rate will be equal to the difference between starting and ending values in RPM divided by 2, or $$\text{Time to accelerate} = (DCV_{new} - RVEL)/2 \qquad \text{Equation 1}$$

In the tension based control loop 53, a web tension feedback signal is input from the exit tensiometer or load cell 13. This is an analog feedback signal, which is converted to a digital signal DIN via an A/D conversion. A low pass digital filter 61 removes unwanted high-frequency components from the tension feedback, with a cutoff value dependent on a parameter DCUT.

An alarm circuit 62 checks the filtered feedback signal DIN against upper and lower alarm limits HLIM and LLIM, respectively, and examines a digital signal AMOD to determine the action to take in the event that the value of the filtered feedback signal DIN falls outside of either limit. The AMOD signal is a digital word which includes two bit positions which are, in effect, alarm flags. In a first bit position, which may be the least significant bit, a 1 value causes an HLIM fault signal to be generated if DIN exceeds HLIM. Similarly, a second bit position, which may be the next least significant bit, causes an LLIM fault signal to be generated if DIN is less than LLIM. A zero value in either alarm flag bit position causes the corresponding alarm condition to be ignored.

The filtered signal DIN from the alarm circuit 62 is input to an invertor 63, which inverts the signal DIN if a parameter INVD is ON. If INVD is OFF, then DIN is not inverted.

The signal DIN, either inverted or normal, is next fed to an adder 64, where a digital setpoint value "setpoint" and a digital signal DOFF are subtracted from it. The setpoint signal is generated by a setpoint control circuit 65 which has a variety of parameters, including SETP, TMIN, TMAX, TVEL and TTIM input thereto. Input parameter SETP is a non-tapered setpoint value. Parameters TMIN and TMAX represent an initial time-based tension setpoint ratio and a final time-based tension setpoint ratio. TVEL is a speed reference for the timebased tension ratio system and THM is the time to slew the setpoint from TMIN to TMAX. If either TVEL or THM is set to zero, then the time-based tension ratio system is disabled and the output of circuit 65 is simply SETP. If both TVEL and THM are non-zero values, then the time-based tension ratio system is enabled and the output of circuit 65 is some ratio of SETP. This ratio slews from TMIN to TMAX over the time period THM, if TVEL is equal to RVEL, but over the time period TVEL/RVEL×THM if TVEL and RVEL are different.

The signal DOFF is a tension feedback DC offset value, which, like the setpoint value, is also subtracted from DIN by the adder 64, with the resulting value being input to a torque sharing and soft start circuit 71 as a system tension feedback adjust signal.

The circuit 71 scales the tension error based upon the load sharing requirements of the system 1 and, therefore, of the corresponding one of the helper motors 21–23. For example, if there are three helper motors 21–23, as shown in FIG. 1, each helper motor should contribute an approximately one-third share of the system drag compensation, as represented by the tension feedback error output from the adder 64. The circuit 71 also performs torque soft start, which limits the maximum torque produced by the corresponding motor 21–23.

An input parameter TSCL sets the percentage of the tension feedback error which the corresponding helper motor 21–23 must assume. The TSCL value for each helper motor will be some value less than 1.0, with the total of all of the TSCL values equal to 1.0. An input parameter TSFT controls the time before the tension error is allowed through the circuit 71 at its maximum. If TSFT is equal to zero, then the soft-start feature is disabled, and the tension error input to the circuit 71 is simply multiplied by TSCL. On the other hand, if TSFF is set to 1, then the time, in seconds, which it takes to slew the output value of the circuit 71 from 0 to 100% of the scaled input value, i.e. the maximum allowed motor torque, is $$\text{time to full scale value} = \text{TSCL} \times \text{TSFT} \qquad \text{Equation 2}$$

The scaled tension feedback error value output from the circuit 71 is then input to an error limiting sub-section 72, which limits the feedback error value to a minimum of DMIN (minimum allowable feedback error) or a maximum of DMAX (maximum allowable feedback error). If the input error value into the sub-section 72 is between these two values, then the actual input value is simply output as the signal ADJ. However, should the input error value exceed DMAX or be less than DMIN, then the relevant limit is output as the signal ADJ.

The signal ADJ is then input into a tension compensation section 73, which section 73 is responsible for stabilizing the material tension control loop 53, producing a compensated tension adjust signal DVEL. While illustrated as a physically discrete section, it should be noted that the compensation is preferably software implemented via a programmable processor. Tension signal compensation is based upon five compensation parameters KA, KB, KINT, KD and KE. KA is a proportional gain constant while KB is a variable, line speed dependent proportional gain. KINT is an integral gain, KD is derivative gain, and KE is an integrator discharge scaling value.

Figure 6:
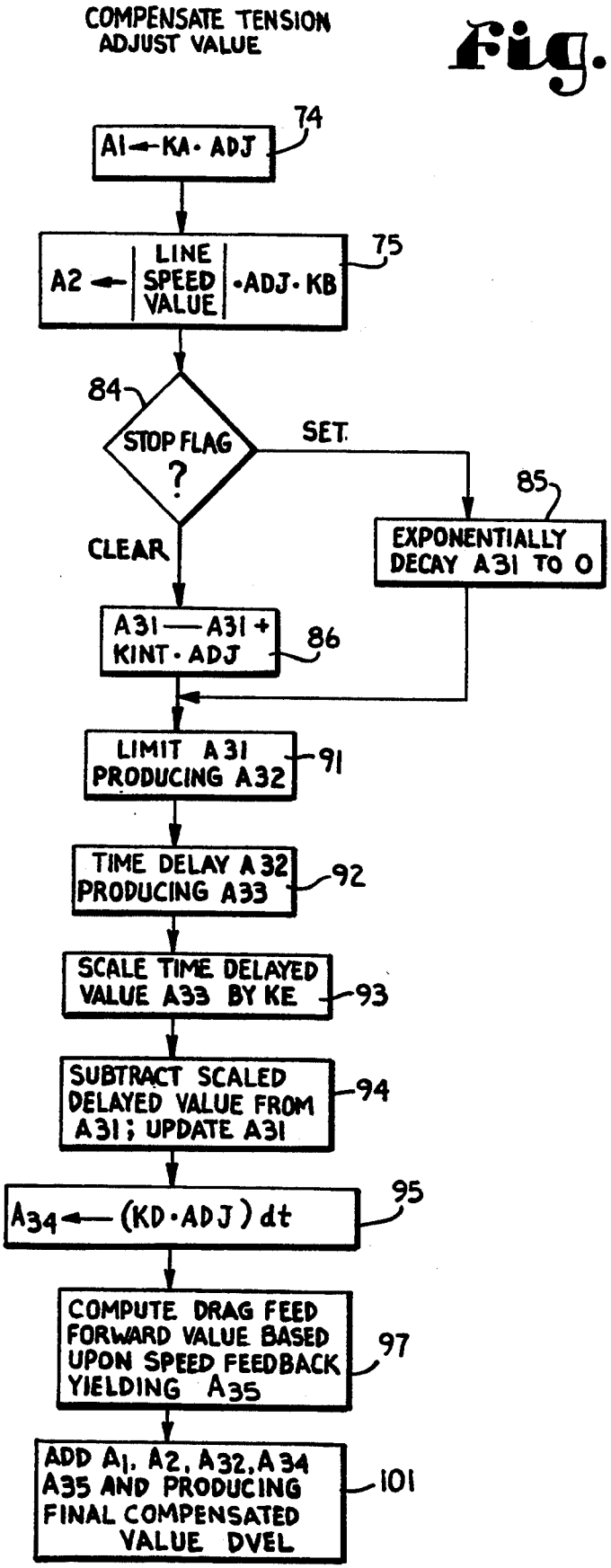
FIG. 6 is a logical flowchart illustrating compensation of the preliminary motor control tension adjustment value.

Referring to FIG. 6 along with FIG. 2, the signal ADJ is first stored and then multiplied by KA, at block 74, with the result labeled $A_1$. ADJ is then multiplied by KB and by the absolute value of RVEL to yield a result labeled $A_2$, at block 75. Next an input line 81 is examined by an integrator 82 for the presence of a stop flag from a zero speed tension control sensor 83, as indicated at block 84. ff the zero speed sensor 83 simultaneously senses a zero value in both target speed (from either FSV or DCV) and a zero value for RVEL as output from the accel/decel generator 54, then it sends a stop flag to the integrator 82 as well as the torque sharing and soft start circuit 71. If the integrator 82 detects the stop flag, it exponentially decays a cumulative stored compensation parameter $A_{31}$, as indicated at block 85. If no stop flag is detected, then the existing $A_{31}$ is replaced by a new value of $A_{31}$, which is computed as follows:

$$A_{31}(new) = A31(old) + (\text{KINT}*\text{ADJ}) \qquad \text{Equation 3}$$

as shown in block 86.

The new value of $A_{31}$ is then limited, yielding a compensation parameter $A_{32}$ which has a maximum value of DIMX and a minimum value of DIMN, at block 91.

In order to prevent the helper motors 21–23 from diverging in performance due to varying voltage offsets and A/D conversion errors, which errors are magnified over time by an integration function, an integrator damping/discharge compensation is provided by time delaying the value $A_{32}$ to produce a value $A_{33}$, which is then scaled by KE and subtracted from $A_{31}$, as indicated at block 92, 93 and 94.

A compensation value $A_{34}$ is produced by multiplying ADJ by KD and differentiating it, as shown in block 95. This compensation value $A_{34}$ is thus proportional to the change in the tension error ADJ, i.e. a positive change in the tension error will produce an instantaneous positive change in speed offset or torque command while a negative change will produce the opposite.

A drag feed forward circuit, indicated as 96 in FIG. 2, interjects a torque command $A_{35}$ based solely upon speed. This drag feed forward circuit is simply a look-up table which contains a number of stored compensation values indexed by speed. A speed signal VEL is input to the table 94 and a compensation value output from the table based upon the speed value input. Such a predictive speed tension compensation table is possible because most drag on material is speed related and can be predicted fairly accurately. By predicting how much torque is required to keep a given material at a constant tension at a certain speed, the tasks of the remainder of the compensation section 73 are greatly simplified since it will not need to compensate for the entire torque range, but will instead be given small, simple error values as inputs. Of course, different tables for different materials can be provided in a divided look-up table. Again in FIG. 6, the drag feed forward compensation value $A_{35}$ is produced in block 97. At block 101, the compensated error values $A_1$, $A_2$, $A_{32}$, $A_{34}$, and $A_{35}$ are added by adder 102 to yield a final compensated tension error value DVEL.

Within the torque control loop 53, a tension enable signal, which can be a 24 VDC input, when deactivated, resets the torque sharing and soft start circuit 71, discharges the integrator 82 to zero, and resets the setpoint ratio in setpoint control circuit 65 to TMIN.

Again referring to FIG. 2, an overspeed torque limiting circuit 103 has, as inputs, RVEL, VEL, DVEL, and a torque limiting variable MXVE. The circuit 103 limits the output torque of the associated motor when the desired line speed RVEL exceeds the motor's feedback velocity by MXVE or greater. Thus, the associated motor controlled by the circuit 51 is prevented from "running away" or "slipping" if the disparity is too great. When the value of RVEL does exceed the value of VEL by more than MXVE, the output signal to the associated motor is pulse width modulated such that it varies between the nominal compensated torque adjust signal value DVEL and zero until the difference between RVEL and VEL is less than MXVE whereupon the control returns to normal.

A torque load final compensation circuit 104 simply converts the compensated torque control signal DVEL into a motor control current IREF which is output on line 105 when a switching control flag TLP is ON. When TLP is OFF, the associated motor is speed controlled via a Proportional-Integral—PI velocity loop 106 to achieve the desired line speed DVEL+RVEL. It should be noted that, when TLP is OFF, the compensated torque control signal DVEL is used as a compensated speed offset value.

Within the speed control loop 52, a lock-up circuit 111 has, as inputs thereto, −RVEL, (RVEL+DVEL), and LOCK, a lock flag signal. The circuit 111 is operative to sense a condition in which the LOCK flag is ON, TLP is OFF, and RVEL is not the same sign as RVEL+DVEL, i.e. the commanded line speed differs in sign from a Proportional-Integral Velocity Loop target command. If all three of these conditions are present, the circuit 111 will command zero speed to prevent the associated motor from turning the wrong way during start-up, which condition helper motors in a multiple motor system are particularly susceptible.

3. Logic Flow Diagrams

In addition to FIG. 6, described above, FIGS. 3–5, 7, 8 and 9 illustrate system logic for other of the control circuits or sections described above and illustrated in block form in FIG. 2.

Figure 3:
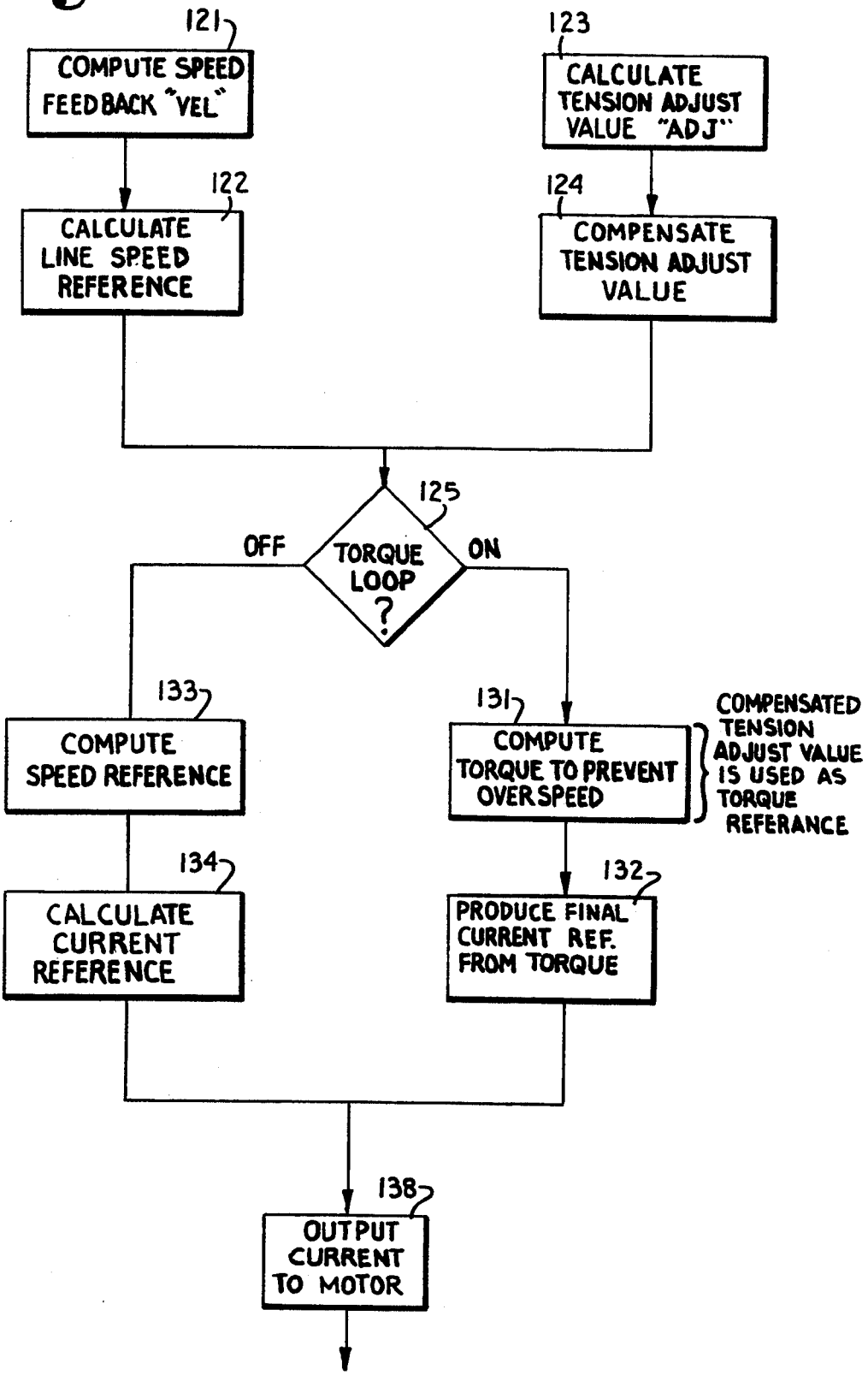
FIG. 3 is a logical flowchart illustrating the overall motor control circuit logic including alternative speed reference and torque reference calculations.

FIG. 3 is an overall system flow diagram. In the speed control loop 52, at block 121, the feedback speed value VEL is computed, and, at block 122, the line speed reference RVEL is computed by the accel/decel generator 54. Alternatively, in the tension control loop 53, at block 123, the uncompensated tension adjust value ADJ is computed via the torque sharing and soft start circuit 71. At block 124, ADJ is compensated via the compensation section 73 to yield the compensated tension adjust signal DVEL.

At block 125, the TLP flag is checked, and, if ON, at block 131, signal DVEL is adjusted to prevent overspeed by the limiting circuit 103, and then, at block 132, a final; current reference signal IREF is produced from DVEL. Conversely, if TLP is OFF, the speed reference is calculated in the PI velocity loop 106 at block 133 and converted to current IREF at block 134 with IREF then output to the associated motor at block 135.

Figure 4:
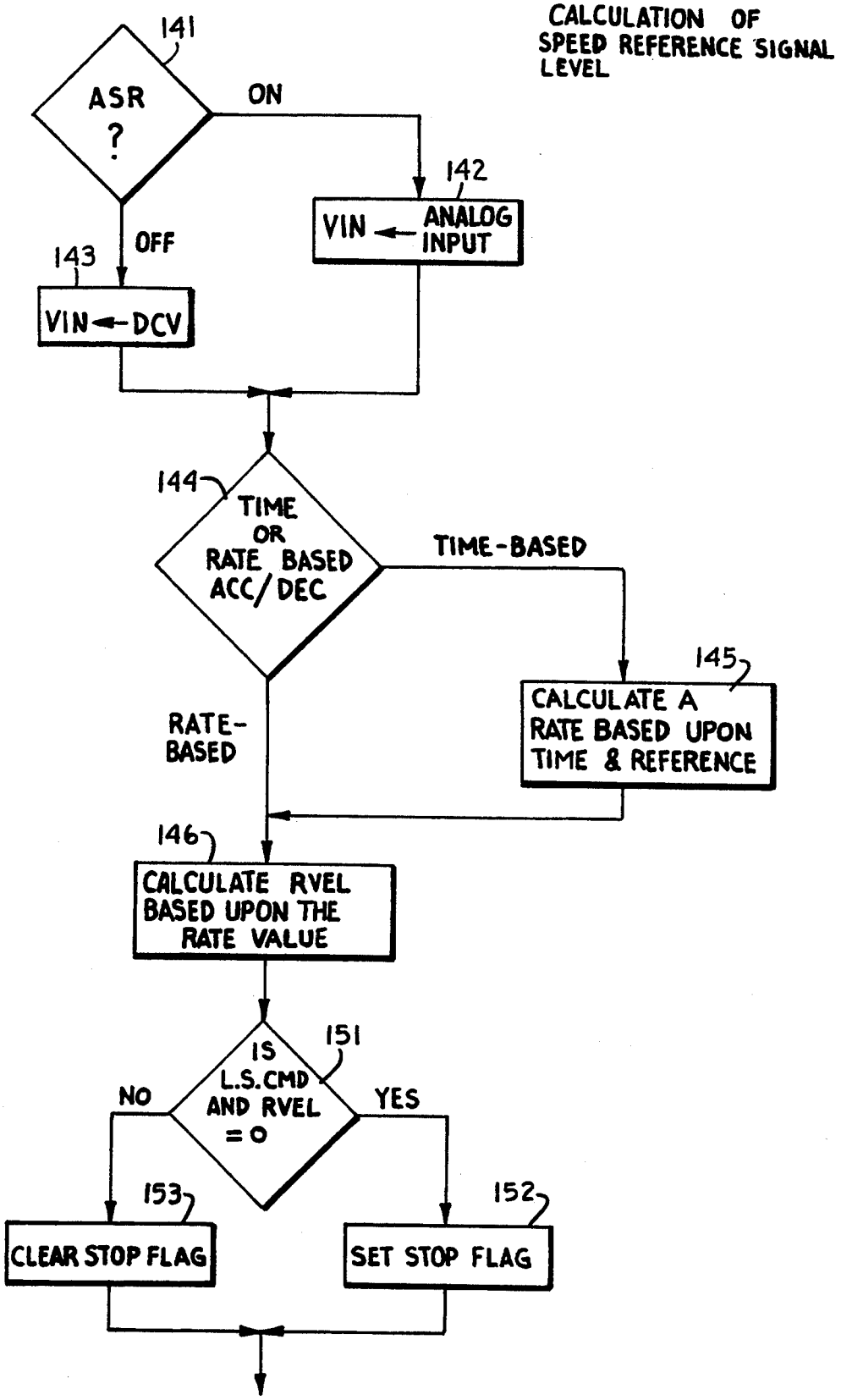
FIG. 4 is a logical flowchart illustrating the calculation of a motor control line speed reference.

FIG. 4 illustrates the calculation of RVEL via the accel/decel generator 54. At block 141, the analog speed reference flag ASR is checked. If it is ON, the speed reference is loaded from the analog input, as scaled by FSV, to yield VIN, or the speed target value at block 142. If ASR is OFF, then VIN is a digital value directly loaded from DCV, at block 143. At block 144, the parameters DDT and DAT are examined to determine whether the accel/decel is to be time or rate based. At block 145, if time based, then a rate is calculated based upon the time input at DDT and DAT as well as VIN and the current value of RVEL. Then, at block 146, the new value of RVEL is repeatedly calculated based upon the rate, either calculated or supplied via DDR and DAR. At block 151, the zero speed tension control circuit 83 checks to see if the commanded line speed input to either FSV or DCV and the calculated value of RVEL are both equal to zero. If this condition is true, then the stop flag is set at block 152, or, alternatively, cleared at block 153, if the condition is false.

In FIG. 5, the calculation of the uncompensated, torque shared tension adjust value ADJ is illustrated. At block 161, the analog value of the tension feedback signal from the exit tensiometer 13 is read, and, at block 162, A/D converted and digitally filtered at block 163. At block 164, the alarm circuit 62 checks the tension feedback to check on alarm limits HLIM and LLIM, and, if the limits are exceeded, the alarm is set at block 165. At blocks 166 and 167, the feedback value is optionally inverted. At block 171, the DC offset value DOFF is subtracted from the tension feedback, and, at block 172, the time based setpoint value is calculated via the setpoint control circuit 65 and then subtracted from the tension feedback at block 173. At block 174, with the soft start function of circuit 71, the tension feedback is ramped from a minimum to a maximum. At block 175, the tension value is scaled for torque sharing, and limited, with the result being the uncompensated tension adjust signal ADJ.

Figure 7:
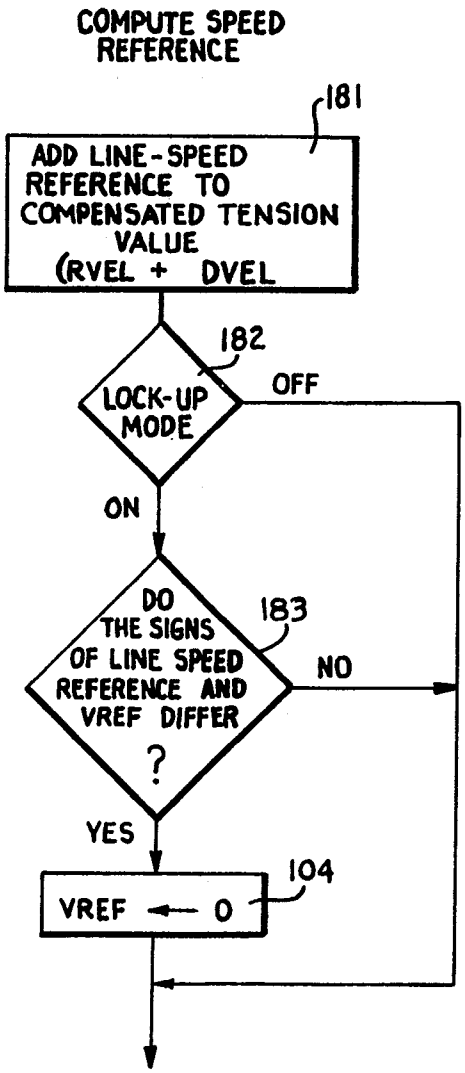
FIG. 7 is a logical flowchart illustrating the calculation of a motor speed reference.

At FIG. 7, the computation of a speed reference is illustrated. At block 181, the line speed reference RVEL is added to the compensated tension adjust value DVEL to yield VREF. At blocks 182 and 183, the lock-up circuit 111, if enabled by the LOCK flag, checks to see if the signs of VREF and RVEL differ and for the presence of a lock flag. If both conditions are present, then the motor is locked up by setting VREF to zero, at block 184. If not, or if the lock circuit 111 is not enabled by flag LOCK, then the calculated value of VREF is output.

Figure 8:
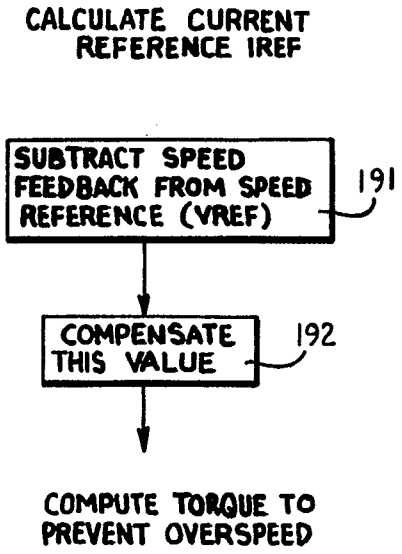
FIG. 8 is a logical flowchart illustrating the calculation of a motor current reference needed to accomplish the calculated speed reference.

At FIG. 8, the motor current reference IREF is calculated in the PI velocity loop 106. At block 191, the feedback speed VEL is subtracted from the calculated speed reference VREF, and then, at block 192, this value is converted to a motor current value IREF.

Figure 9:
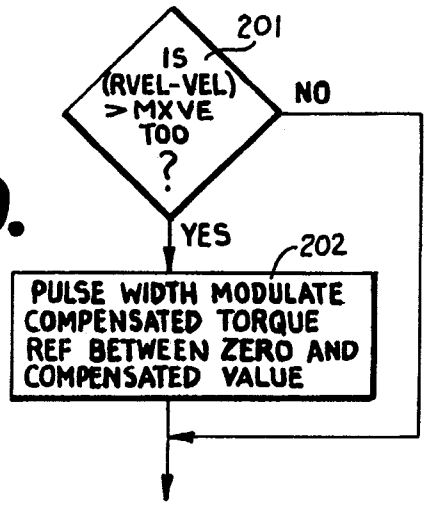
FIG. 9 is a logical flowchart illustrating the selective generation of a pulse width modulated compensated torque reference to prevent system overspeed.

At FIG. 9, the function of the overspeed torque limit section 103 is illustrated. At block 201, the speed feedback signal VEL is checked to see if the difference between it and the speed reference signal RVEL is too high, i.e. is RVEL−VEL greater than MXVE. If not, then the compensated tension value DVEL is sent on to be directly converted to a motor current signal. If MXVE is exceeded, then the compensated tension value DVEL is pulse width modulated, i.e. pulsed between values of zero and DVEL at regular intervals until MXVE is no longer exceeded, as shown in block 202.

III. Conclusion

The present inventive motor control circuit for web tensioning systems has permitted helper motors to be greatly down-sized since each helper motor is now reliably responsible only for its proportionate share of drag compensation. In addition, a number of tension sensors required in prior art systems have been eliminated, resulting in substantial cost savings and maintenance reductions. At the same time, tension throughout the web at each portion of the web path is much more uniform than with prior art control systems, and the material web 2 can be safely and reliably drawn through the vat 3 at much higher speeds and production rates.

While various circuit elements and sections have been illustrated and labeled as separate blocks, it should be apparent that many of the recited control functions performed by these blocks can be performed by a suitably programmed common processor. While treatment of a textile web is mentioned for the web tensioning system 1, it should be apparent that any material web tensioning system can be similarly controlled, e.g. thin film plastic webs, thin metallic webs, photographic film webs or the like. Furthermore, the basic control system can be used in any master-slave process controller network, such as those used in overhead cranes, for example.

Each of the system parameters defined above are defined in the accompanying appendix. It should be noted that these parameters must be fine tuned for different typed of web materials and different system drag conditions.

It is to be understood that while certain forms of the present invention have been illustrated and described herein, it is not to be limited to the specific forms or arrangement of parts described and shown.

TABLE 1

Parameters
Appendix A
Web Parameters - Standard and Shared-load

| Parameter | Scaling | Notes |
|---|---|---|
| KA | TLP = ON: Amps/Volts<br>TLP = OFF: RPM/Volt | proportional tension gain; (TLP = ON) control the commanded torque (current) per volt of tension error. (TLP = OFF) controls the velocity offset (DVEL) per volt of tension error. |
| KB | 1/Volt | ramped-velocity-dependent proportional tension gain; (TLP = ON) when set to a non-zero value, KB essentially controls how much the commanded torque will be increased for each RPM in the reference velocity, and each volt of tension error. (TLP = OFF) when set to a non-zero value, KS essentially controls how much additional velocity offset (DVEL) will be added for each RPM in the reference velocity, and each volt of tension error. |
| KINT | TLP = ON: (Amp-seconds)/Volts<br>TLP = OFF: (RPM-seconds)/Volt | integral tension gain; (TLP = ON) controls the rate at which the commanded torque will be increased per volt of tension error. (TLP = OFF) controls the rate at which the velocity offset (DVEL) will be increased per volt of tension error. |
| LOCK | ON/OFF | controls the "lock-up" mode. |
| KD | — | Derivative tension gain; (TLP = ON) commands a torque proportional to the rate of change of the tension feedback signal. (TLP = OFF) modifies the commanded line speed reference by a value which is proportional to the rate of change of the tension feedback signal. |
| TTIM | seconds | time control variable for tapered setpoint control. |
| TVEL | RPM | reference line speed for tapered setpoint control; TVEL = O disables tapered setpoint control. |
| TMIN | — | minimum ratio for tapered setpoint control. |
| TMAX | — | maximum ratio for tapered setpoint control. |
| DCUT | 6.283*Hz | controls the cutoff frequency of the low-pass digital filter for tension feedback. DCUT = O disables the low-pass filter, and passes the tension feedback signal directly into to the tension loop. |
| INVD | ON/OFF | controls whether (ON) or not (OFF) the tension feedback signal should be inverted before being passed to the tension loop. |
| DCM | ON/OFF | these two parameters control where the line speed reference |
| ASR | ON/OFF | value is computed from. If DCM is OFF, the line speed reference is computed based upon FSV and the analog input speed reference. If DCM is ON, then ASR controls where the line speed originates from. If ASR is ON, then the analog input is used in conjunction with FSV. If ASR is OFF, then the digital value contained in DCV is used. DCM is a global parameter, and is not stored in the multiple parameter sets. |
| FSV | RPM at 10 V input | line speed reference input; when the line speed input voltage is 10 VDC, the command line speed is the value contained in FSV. FSV is a global parameter, and is not stored in the multiple parameter sets. |
| DAT | seconds | sets the acceleration time for line speed reference changes; when set to a non-zero value, DAT controls the ramp time when the line speed reference changes; this ramping can be interrupted by a change in the line-speed reference. |
| DAR | RPM/second | sets the acceleration rate for line speed reference changes; active only when DAT is zero. |
| DDT | seconds | sets the deceleration time for line speed reference changes; when set to a non-zero value, DDT control the ramp time when the line speed reference changes; this ramping can be interrupted by a change in the line-speed reference. |
| DDR | RPM/second | sets the deceleration rate for line speed reference changes; active only when DDT is zero. |
| TSFT | — | controls the time before the tension error is allowed through at it's maximum (as controlled by TSCL). If TSFT is set to zero, the soft-start sub-section is completely disabled, and tension feedback (error) is allowed |

TABLE 1-continued

| Parameters Appendix A Web Parameters - Standard and Shared-load | | |
|---|---|---|
| Parameter | Scaling | Notes |
| | | to change from zero to maximum at any time. |
| TSCL | percent | sets the percent of tension feedback (error) this axis is responsible for controlling. If it is desired to operate the axis in non-tension-loop mode. TSCL should be set to 1.0 (100%). If, however, the axis is being operated in tension-loop mode as a "helper" axis, TSCL should be set to some value less than one, with the total among the "helper" motors totaling one. |
| MXVE | RPM | controls the maximum speed (over the current line speed reference) this axis is allowed to run at active. only in tension loop mode (TLP = ON). |
| SETP | Volts | sets the desired tension reference value. |
| DCV | RPM | sets the digital line speed reference value. used when DCM is ON and ASR is off. |
| AZW | RPM | active when ASR is ON and active; controls when a digital zero speed reference is commanded. when the absolute value of the analog line reference (times FSV) is less than the value programmed in the AZW parameter, a digital zero speed reference is commanded. |
| DMIN DMAX | Volts | controls the maximum (DMAX) and minimum (DMIN) tension error values, which in turn feed the tension compensators. |
| DIMIN DIMX | TLP = ON: Amps TLP = OFF: RPM | controls the maximum (DMAX) and minimum (DIMIN) output values of the tension integrator. |
| HLIM | Volts | high alarm limit. |
| LLIM | Volts | low alarm limit. |
| AMOD | — | control whether or not HLIM and LLIM faults are generated. when bit 0 is ON and DIN > HLIM, and HLIM fault is generated; when bit 1 is ON and DIN < LLIM, and LLIM fault is generated. |

What is claimed and desired to be secured by Letters Patent is as follows:

1. In a web tensioning system including a single exit drive motor and a plurality of helper drive motors, each said drive motor being controlled by a separate motor control circuit, each said control circuit comprising:
(a) a web speed based control loop;
(b) a separate web tension based control loop; and
(c) means for alternatively selecting either said speed based control loop or said tension based control loop for controlling the corresponding drive motor.

2. The invention as in claim 1, wherein said speed based control loop comprises:
(a) input means for inputting a target speed value into an acceleration/deceleration rate limiting means;
(b) said rate limiting means outputting a web speed value derived from said target speed, said rate limiting means controlling said web speed value such that the rate of web acceleration or deceleration is limited to allow smooth acceleration or deceleration of said corresponding motor.

3. The invention as in claim 2, wherein said rate limiting means comprises:
(a) means for selecting a time limit or a rate limit method of acceleration/deceleration; and
(c) means for selecting rate limit parameters for the selected time limit or rate limit method.

4. The invention as in claim 1, wherein said tension based control loop comprises:
(a) input means for inputting a web tension feedback signal; and
(b) means for generating a compensated tension adjust signal derived from said tension feedback signal.

5. The invention as in claim 4, wherein said means for generating comprises:
(a) means for comparing said web tension feedback signal against high and low alarm limits.

6. The invention as in claim 4, wherein said means for generating comprises:
(a) means for scaling said web tension feedback signal relative to a setpoint to yield an uncompensated tension adjust signal.

7. The invention as in claim 6, wherein said means for generating further comprises:
(a) soft start means for selectively slewing said setpoint value from a minimum to a maximum during system startups to thereby limit the maximum torque which can be applied to a web by the corresponding drive motor.

8. The invention as in claim 7, wherein said soft start means can be selectively set to slew said setpoint value over a set time period or, alternatively, at a set rate.

9. The invention as in claim 6, wherein said tension based control circuit further comprises:
(a) means for compensating said uncompensated tension adjust signal relative to a plurality of compensation parameters.

10. The invention as in claim 9, wherein said means for compensating compensates said uncompensated tension adjust signal for both a fixed and a line speed dependent, proportional gain.

11. The invention as in claim 9, wherein said means for compensating compensates said uncompensated tension adjust signal for an integral gain.

12. The invention as in claim 11, wherein said means for compensating partially offsets said integral gain to prevent the associated controlled motor from diverging from other motors due to voltage offsets and A/D conversion errors.

13. The invention as in claim 9, wherein said means for compensating compensates said uncompensated tension adjust signal for a derivative gain.

14. The invention as in claim 9, wherein said means for compensating comprises:

(a) drag feed forward means for supplying a predicted value of tension adjust signal based upon a system speed feedback.

15. The invention as in claim 14, wherein said drag feed forward means comprises:

(a) a look up table for storing tension adjust signal values indexed to system speed feedback inputs.

16. The invention as in claim 1, wherein said control circuit further comprises:

(a) overspeed control means for preventing the associated motor from entering an overspeed condition.

17. The invention as in claim 16, wherein said overspeed control means comprises:

(a) means for comparing a difference between a desired speed control signal and a speed feedback signal to a maximum velocity difference parameter; and (b) means for pulse width modulating a motor current signal when said difference is greater than said maximum velocity difference parameter.

18. A web tensioning system for pulling a web of material under uniform tension through a path from an entrance to an exit, said system comprising:

(a) an exit drive motor positioned near said exit, said exit motor coupled to a drive pinch roller for selectively pulling said web through said path;

(b) a plurality of helper motors positioned between said entrance and said exit, each said helper motor being coupled to an associated helper pinch roller for selectively propelling said web;

(c) an exit tension sensing means for detecting the amount of tension on said web as it exits said path and generating an exit tension signal indicative of said web exit tension;

(d) a plurality of motor control circuits, a separate one of said motor control circuit controlling each of said helper motors, each of said motor control circuits having as a feedback input said exit tension signal, each said motor control circuit selectively providing tension based control of its associated helper motor to load share any drag on said web as it follows said path with the other helper motor(s) based solely on feedback from said exit tension signal and a speed feedback signal from its associated motor.

19. The invention as in claim 18, wherein each of said motor control circuits comprises:

(a) a web speed based control loop;

(b) a separate web tension based control loop; and (c) means for alternatively selecting either said speed based control loop or said tension based control loop for controlling the corresponding drive motor.

20. The invention as in claim 19, wherein said tension based control loop comprises:

(a) input means for inputting a web tension feedback signal; and (b) means for generating a compensated tension adjust signal derived from said tension feedback signal.

21. The invention as in claim 20, wherein said means for generating comprises:

(a) means for comparing said web tension feedback signal against high and low alarm limits.

22. The invention as in claim 20, wherein said means for generating comprises:

(a) means for scaling said web tension feedback signal relative to a setpoint to yield an uncompensated tension adjust signal.

23. The invention as in claim 22, wherein said means for generating further comprises:

(a) soft start means for selectively slewing said setpoint value from a minimum to a maximum during system startups to thereby limit the maximum torque which can be applied to said web by the corresponding drive motor.

24. The invention as in claim 23, wherein said soft start means can be selectively set to slew said setpoint value over a set time period or, alternatively, at a set rate.

25. The invention as in claim 22, wherein said tension based control circuit further comprises:

(a) means for compensating said uncompensated tension adjust signal relative to a plurality of compensation parameters.

26. The invention as in claim 25, wherein said means for compensating compensates said uncompensated tension adjust signal for both a fixed and a line speed dependent, proportional gain.

27. The invention as in claim 25, wherein said means for compensating compensates said uncompensated tension adjust signal for an integral gain.

28. The invention as in claim 27, wherein said means for compensating partially offsets said integral gain to prevent the associated controlled motor from diverging from other motors due to voltage offsets and A/D conversion errors.

29. The invention as in claim 25, wherein said means for compensating compensates said uncompensated tension adjust signal for a derivative gain.

30. The invention as in claim 25, wherein said means for compensating comprises:

(a) drag feed forward means for supplying a predicted value of tension adjust signal based upon a system speed feedback.

31. The invention as in claim 30, wherein said drag feed forward means comprises:

(a) a look up table for storing tension adjust signal values indexed to system speed feedback inputs.

32. The invention as in claim 18, wherein said control circuit further comprises:

(a) overspeed control means for preventing the associated motor from entering an overspeed condition.

33. The invention as in claim 32, wherein said overspeed control means comprises:

(a) means for comparing a difference between a desired speed control signal and a speed feedback signal to a maximum velocity difference parameter; and (b) means for pulse width modulating a motor current signal when said difference is greater than said maximum velocity difference parameter.

34. In a web tensioning system including a single exit drive motor and a plurality of helper drive motors, each said drive motor being controlled by a separate motor control circuit, each said control circuit comprising:

(a) a web tension based control loop including means for scaling a web tension feedback signal relative to a setpoint value to yield an uncompensated tension adjust signal; and (b) soft start means for selectively slewing said setpoint value from a minimum to a maximum during system startups to thereby limit the maximum torque which can be applied to a web by the corresponding drive motor.

35. In a web tensioning system including a single exit drive motor and a plurality of helper drive motors, each said drive motor being controlled by a separate motor control circuit, each said control circuit comprising:

(a) a web tension based control loop including means for scaling a web tension feedback signal relative to a setpoint value to yield an uncompensated tension adjust signal; and (b) overspeed control means for preventing the associated motor from entering an overspeed condition.

36. The invention as in claim 35, wherein said overspeed control means comprises:

(a) means for comparing a difference between a desired speed control signal and a speed feedback signal to a maximum velocity difference parameter; and (b) means for pulse width modulating a motor current signal based upon said tension adjust signal when said difference is greater than said maximum velocity difference parameter.

* * * * *